US005113546A

United States Patent [19]

Parent

[11] Patent Number: 5,113,546

[45] Date of Patent: May 19, 1992

[54] COMPUTER SERVICING CART WITH STRUCTURAL FRAME

[75] Inventor: Richard Parent, Lake Bluff, Ill.

[73] Assignee: Alternative Resources Corporation, Lincolnshire, Ill.

[21] Appl. No.: 599,986

[22] Filed: Oct. 19, 1990

[51] Int. Cl.[5] ..... A47L 5/00

[52] U.S. Cl. ..... 15/315; 15/321; 15/323; 242/86.2; 312/250

[58] Field of Search ..... 15/315, 321, 323, 326; 280/47.35, 47.26, 47.24; 242/86.2, 86.3; 312/250, 324

[56] References Cited

U.S. PATENT DOCUMENTS

| | | | |
|---|---|---|---|
| 2,634,189 | 4/1953 | Hill | 312/250 |
| 3,401,420 | 9/1968 | Lofgren | 15/315 |
| 3,453,001 | 7/1969 | Wellington et al. | 280/47.35 |
| 3,573,879 | 4/1971 | Bergkamp | 280/47.35 X |
| 4,070,075 | 1/1978 | Morgan | 312/250 |
| 4,118,048 | 10/1978 | Spranger et al. | 280/47.35 |
| 4,344,660 | 8/1982 | Molnar et al. | 312/324 X |
| 4,474,416 | 10/1984 | Rogann | 312/250 X |
| 4,652,062 | 3/1987 | Greenwood | 280/47.35 X |
| 4,759,560 | 7/1988 | Virgulti | 280/47.26 |
| 4,989,291 | 2/1991 | Parent | 15/315 |

FOREIGN PATENT DOCUMENTS

| | | | |
|---|---|---|---|
| 1324963 | 7/1973 | United Kingdom | 312/250 |

*Primary Examiner*—William A. Cuchlinski, Jr.
*Assistant Examiner*—James K. Folker
*Attorney, Agent, or Firm*—Hill, Van Santen, Steadman & Simpson

[57] ABSTRACT

This invention relates to a computer servicing cart which includes a structural frame for use in defining a housing for the cart and for use in carrying and rollably supporting said housing. The frame includes a base, uprights, and angular struts connecting the uprights and base. A cross member and a handle are secured to the uprights. Rolling means are secured to the base. Rearward rolling means are provided and includes an angularly disposed mount system for positioning larger rear wheels rearwardly for ease of rolling. The housing is formed about the frame and includes a forward section and a rearward section. The forward section is provided for carrying servicing items and the rearward section carries a vacuum tank, gas cylinder and a hose reel. The rearward section includes a depressed well section in the center thereof for receiving the hose reel in a lowered position. The top of the cart includes a foldable top for opening onto the handle and providing a work surface.

8 Claims, 4 Drawing Sheets

COMPUTER SERVICING CART WITH STRUCTURAL FRAME

BACKGROUND OF THE INVENTION

This invention relates to computer servicing carts, and more particularly to the construction of a cart for use in servicing and/or cleaning computer terminals.

Microcomputers and peripheral devices are becoming increasingly important in the workplace. For example, terminals or personal computers can be used in offices, engineering departments, and the like. From time to time it is necessary and desirable to clean these devices on site. Repair of the computers is normally done by removing the computer to an off-site location. Repair is different from cleaning or providing preventive maintenance. In order to clean the computers, it is necessary to clean parts, such as the keyboard, central processing unit and/or printer by disassembly, vacuuming, closing, etc. Computer servicemen would clean these computers by carrying in tools individually or in a satchel to the location for cleaning. In addition, it is sometimes desirable for the servicemen to clean the unit at the desk or location of the PC, thus inconveniencing the operator or the organization of their work area.

It has been found to be desirable to provide a more compact way of reliably bringing tools, such as hand tools, cleaning solutions, a vacuum cleaner and/or a blowing apparatus to the work site. In addition, it has been found to be desirable to provide a servicing work surface for cleaning without disturbing the operator.

In U.S. Pat. No. 4,989,291, a computer servicing cart is disclosed. That cart appears to have solved the problems which existed at that time. However, that cart included a cabinet mounted on wheels and as a result the cart tended to twist or rack during movement and it was also found to be desirable to provide an improved mounting for the rear wheel assembly for ease of moving the unit up and down stairs.

Therefore, it is an object of this invention to provide an improved cart which addresses the foregoing problems and which still provides desirable servicing and carrying features of a computer cart.

These and other objects of this invention will become apparent from the following disclosure and appended claims.

SUMMARY OF THE INVENTION

There is provided by this invention a cart for use in servicing and cleaning computer equipment or peripheral devices which includes a structural frame having a housing built thereabout, wheels secured to the base of the frame, and the rear wheels angularly secured to the frame so as to extend rearwardly and permit rolling of the cart on stairs and the like. The cart includes a rearward housing which carries a cylinder for gas to blow clean the work, a hose reel centrally positioned in a depressed well and a vacuum.

The tools and utensils may be secured to various shelves and pockets formed and secured to the front wall of the housing. Clamshell doors are secured to the front wall of the housing so as to be openable and closable about the item carrying shelves and pockets.

An electrical system is provided in association with the cart which includes an electric power cord coiled about a retractable reel which is plugable into a power supply. This powers the cart. A circuit is provided for activating a duplex outlet in association with the cart as well as the vacuum associated with the cart. Various indicator lights are provided.

In addition, the housing includes an openable top which defines a surface which may be folded to an open position in engagement with a cart handle and which may be positioned for receiving a computer component.

Various doors and openings are provided in association with the housing for access of the interior of the cart.

DESCRIPTION OF THE PREFERRED EMBODIMENT

Figure 1:
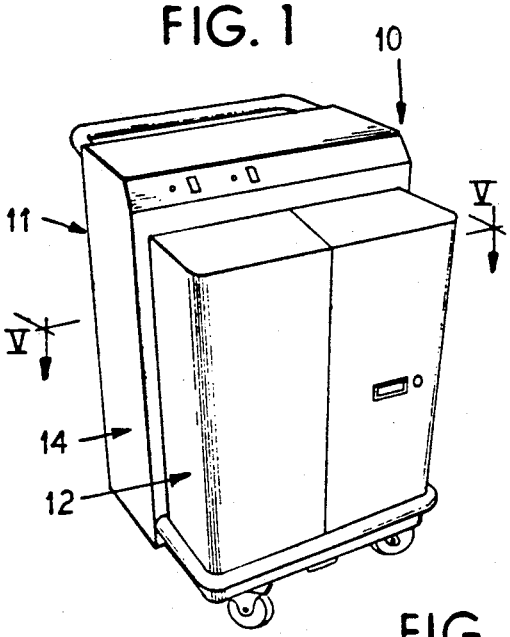
FIG. 1 shows a perspective view of the cart.
Figure 3:
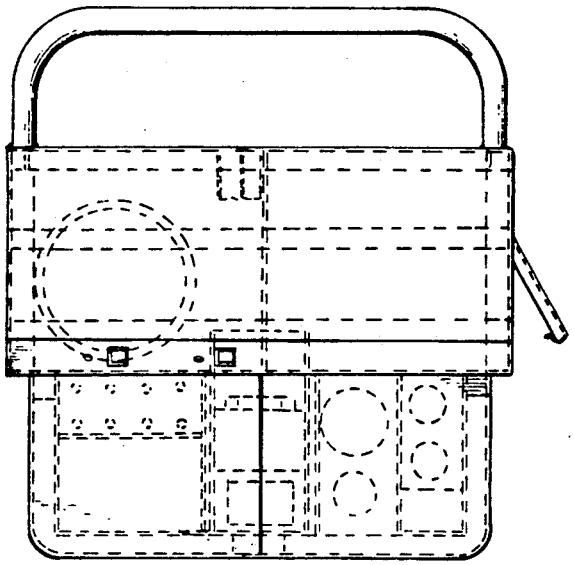
FIG. 3 is a top plan view of the cart showing elements of the interior of the cart.

Referring now to FIG. 1, there is shown a cart 10 which includes a housing 11 which includes a front section 12 and a rear section 14. These sections are mounted on a frame and rollers as will be described hereinafter. The rear section 14 is fabricated of steel and the front section 12 is fabricated of aluminum and is mechanically secured to the rear section.

Figure 2:
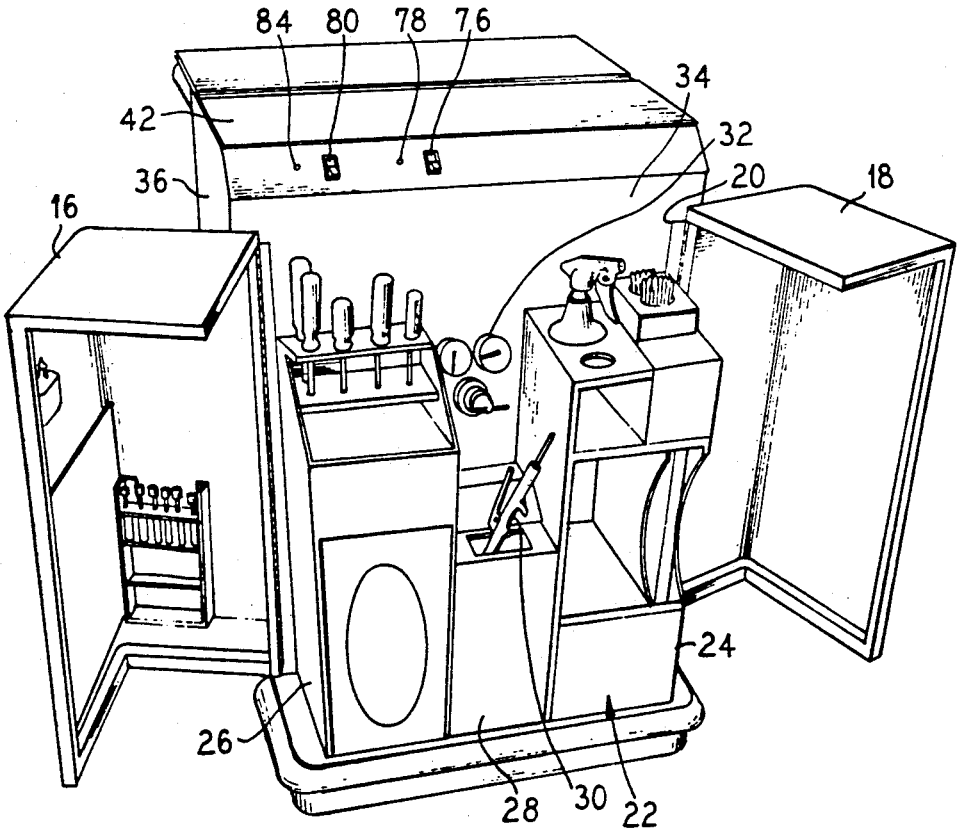
FIG. 2 shows a perspective and generally frontal view of the cart showing the clamshell doors open and various tools and items carried therein.

Referring now to FIG. 2, the front section includes a pair of clamshell-like doors 16 and 18 which are fabricated of aluminum and which are hingedly secured along piano hinges such as 20 to the rear section. A tool holder assembly such as 22 is provided and as can be seen defines a pair of towers or left- and right-hand sections 24 and 26 and a center section 28. The left-hand section is constructed to carry items such as cotton-tipped swabs (sometimes referred to as Q-TIPS) or a squeeze bottle of solvent while the section 26 carries tools such as screwdrivers and a wiper container.

The center section 28 includes an opening through which a nozzle 30 from a gas hose reel projects. This permits some communication between the front and rear sections. A gas regulator system 32 extends through the front wall of the rear section and into the front section.

The rear section includes the front wall 34, side walls 36 and 38, and the rear wall 40. A top wall 42 is provided and defines a foldable and hinged top which is constructed to lay flat and provide a flat working surface.

Figure 5:
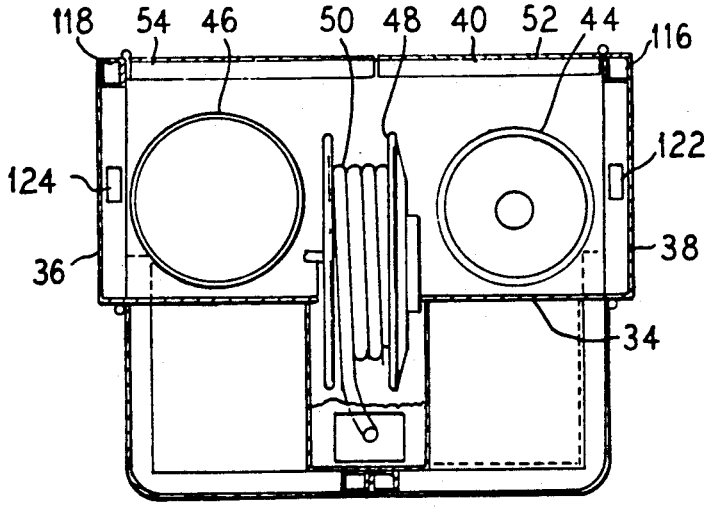
FIG. 5 is a sectional view taken along line V—V of FIG. 1 showing the interior of the front and rear sections of the cart.

Referring no to FIG. 5 the rear section includes a vacuum tank 44 and a gas cylinder mounting position or collar 46 on either side of the rear section. A hose reel 48 which carries a hose 50 is positioned between and below the tank and collar. The rear wall 40 includes a pair of doors 52 and 54.

Figure 4:
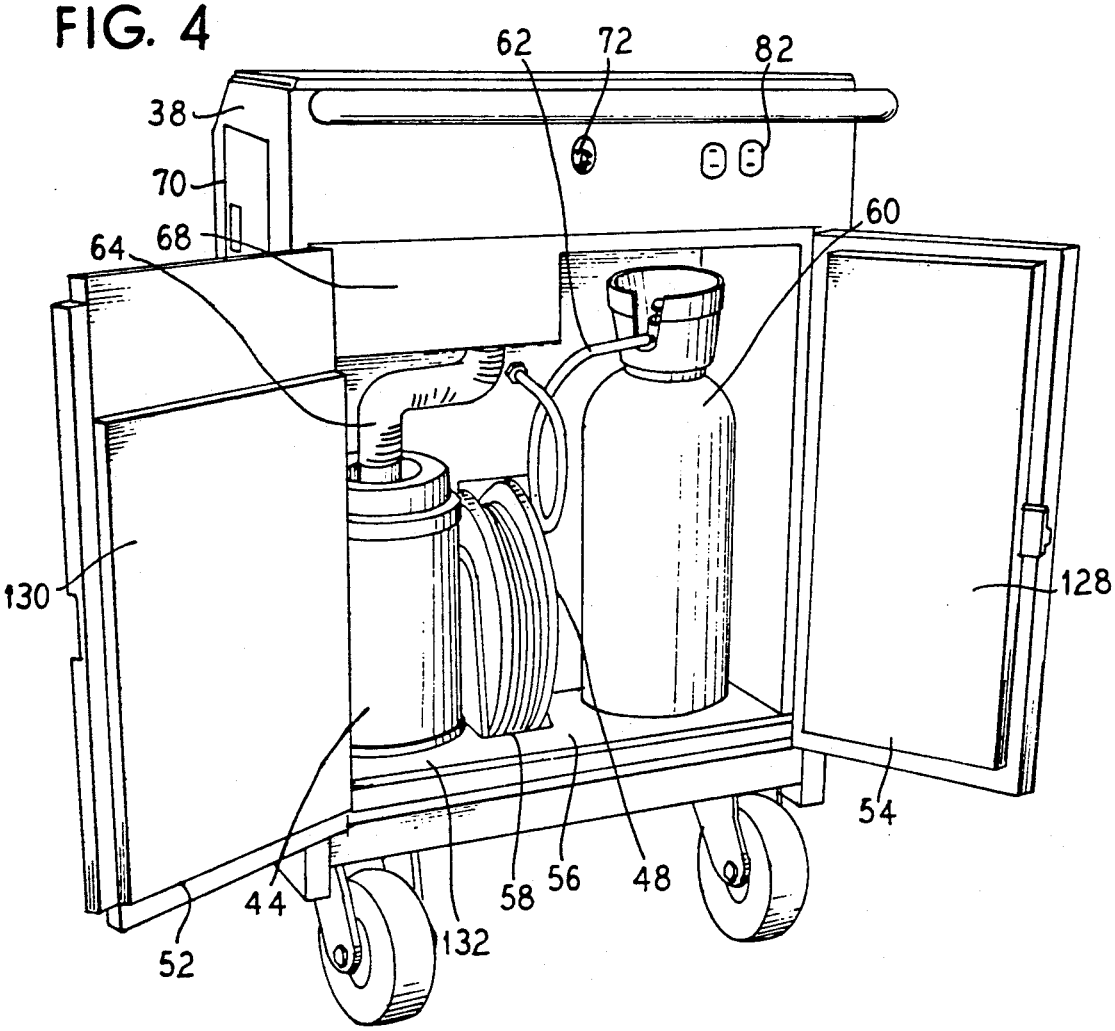
FIG. 4 is a perspective view of the back of a cart showing the rear doors open.

Referring now to FIG. 4, the doors 52 and 54, which are fabricated of aluminum, are shown in the open position and the cart includes a floor portion 56 which defines a recess 58 into which the hose reel 48 fits. The gas cylinder 60 fits into the collar 46 and a line 62 connects the gas cylinder to the regulator 32. From the regulator a line is connected to the hose 50 and the reel 48 and from there to the nozzle 30 as shown in FIG. 2. The vacuum tank 44 includes the vacuum inlet 64 which is connected to a vacuum hose as seen in FIG. 7 and which is stored in a compartment 68 above the tank 44 and is accessible through a side door 70 in the side 38.

Figure 7:
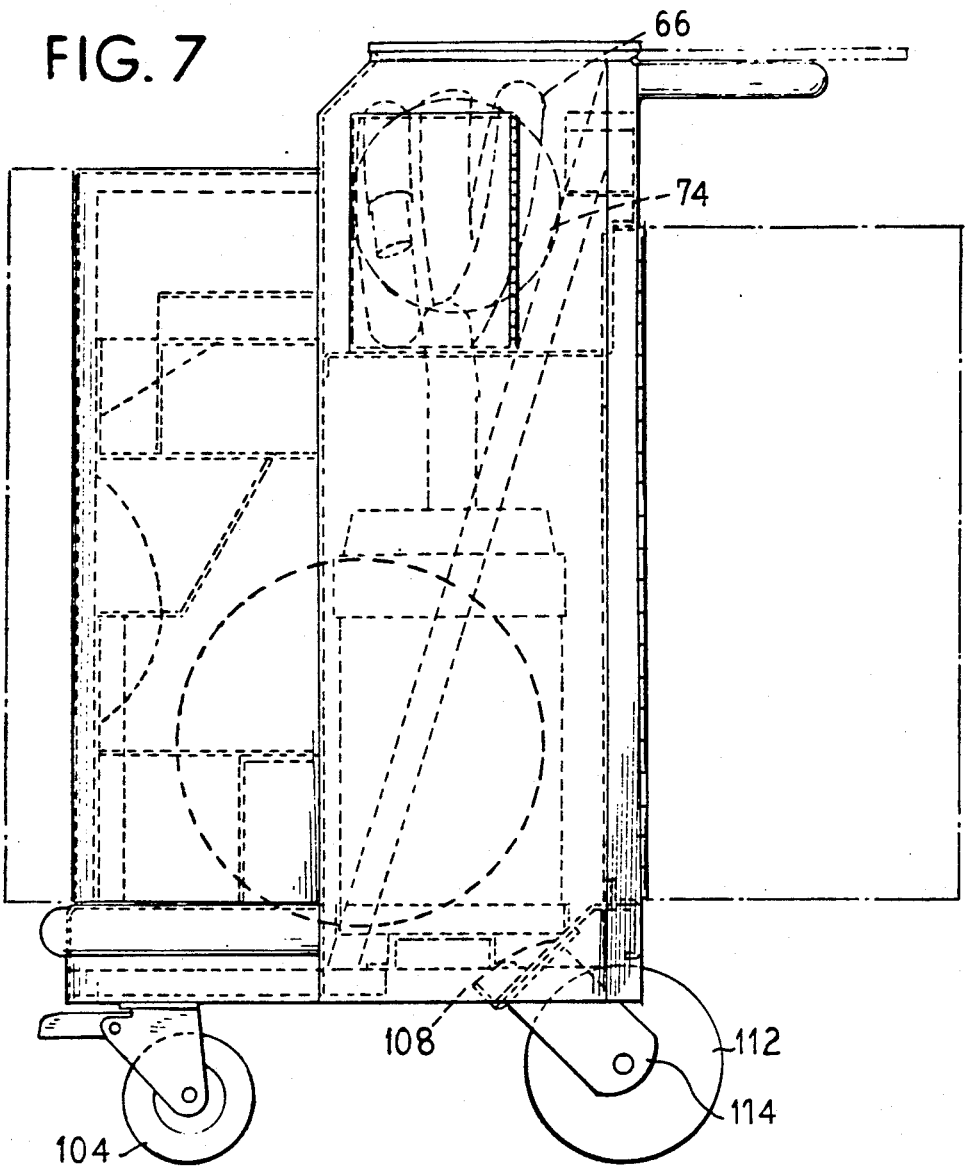
FIG. 7 is a side elevational view showing the interior of the cart front and rear sections and the recoilable electric coil.
Figure 8:
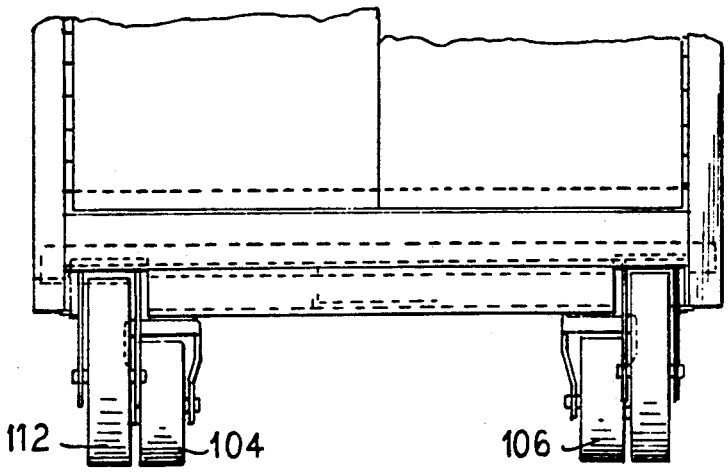
FIG. 8 is a rear elevational view showing the bottom portion of the cabinet.

Electric power is brought to the cart via a cord whose plug 72 is seen in FIG. 4 and connects to a retractable-style reel 74 best seen in FIG. 7. From the reel power is delivered to two switch systems. A first switch indicated by numeral 76 in FIG. 2 controls the power to the vacuum 44. An indicator light 78 indicates that the cart is powered. A second switch 80 controls delivery of power to a duplex outlet 82 in the rear of the cart. Indicator light 84 indicates the status of the duplex outlet 82.

Figure 6:
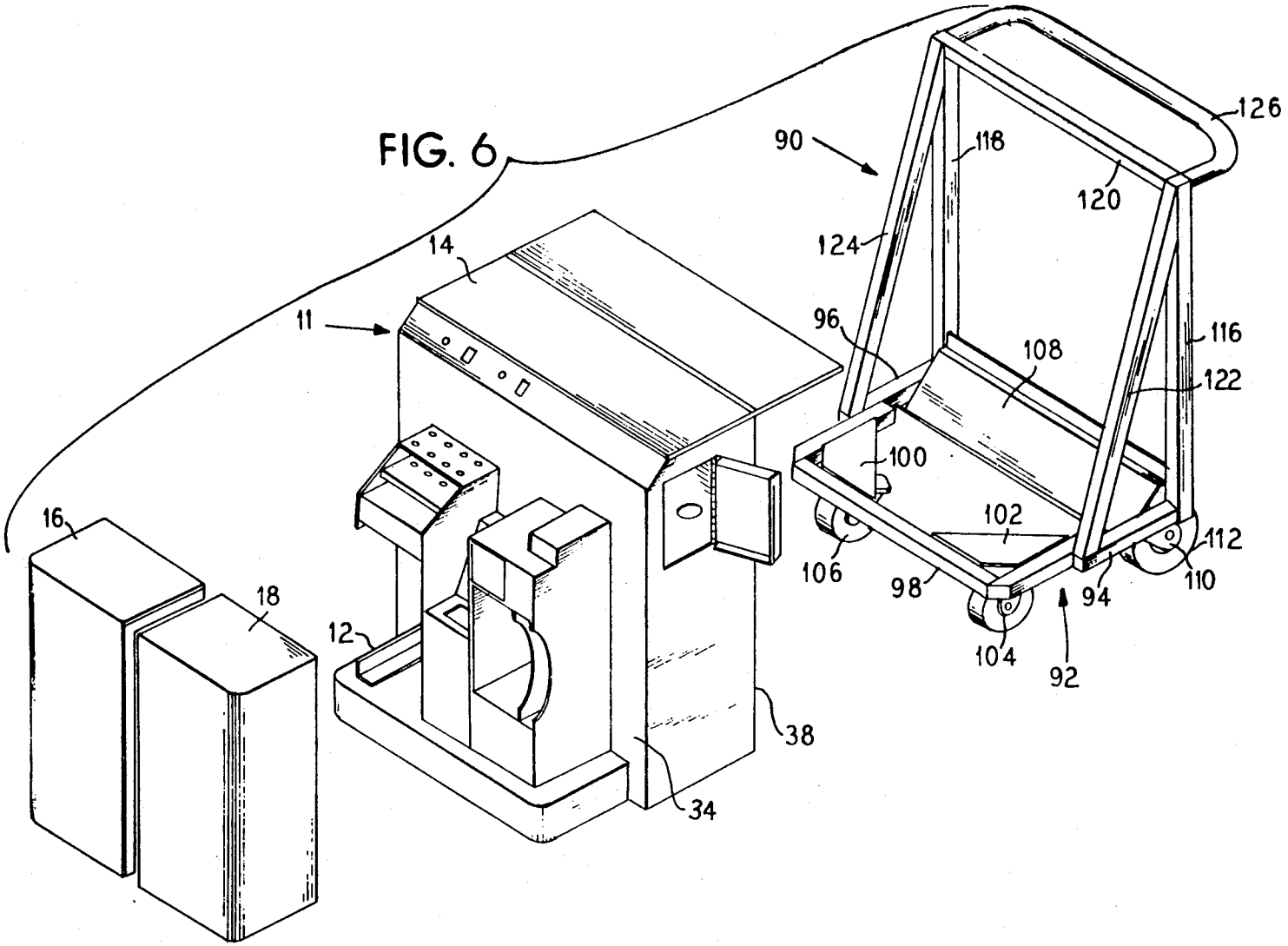
FIG. 6 is an exploded perspective view showing the cart frame rear portion and front clamshell doors.

Referring now to FIG. 6, it is seen that the cart can be considered to include several basic components, namely, the frame 90, the housing 11, and sections 12 and 14 and the doors 16 and 18. Referring first to the frame, it is seen that the frame includes a base or horizontal portion 92 which includes a pair of side members 94 and 96 and a front member 98. A pair of front wheel supports 100 and 102 are secured between the side and the front or the front and side members and carry therebelow the front casters 104 and 106. It is noted that the front portion of the base is slightly indented or smaller than the rear portion. The rear of the frame includes an angled rear wheel mounting plate 108 to which a rear wheel bracket such as 110 is secured and to which in turn a wheel such as 112 is secured. It is noted that as shown in FIG. 7 the rear wheel support 110 is angularly secured to the mounting bracket 108 and that the wheel 112 is larger in diameter than the front wheel 104 and the center of rotation of the wheel 114 is generally aligned with the back of the cart.

The cart also includes a pair of uprights 116 and 118 which extend upwardly from the base at the back of the cart. A cross member 120 is secured to the uprights at the top. A pair of struts 122 and 124 are angularly positioned and connect the top of each upright such as 116 to the base such as 94. This provides rigidity to the frame. The cart also includes a handle 126 secured to the upright at the top end thereof. The housing 11 is a sheet metal housing which includes the walls or panels 34, 36 and 38 and is secured to the frame. The housing and frame are -in effect integral. The manner in which the sheet metal is fitted is seen in FIG. 5.

The front section 12 are pop riveted to the front wall 34 of the rear section and are mechanically removable therefrom. The front section doors 16 and 18 are secured to the front wall of the rear section by piano hinges as described before.

Referring to FIG. 4, the interior of the rear housing includes sound deadening material such as foam pads 128 and 130 on the door and 132 on the floor.

Although the invention has been described with respect to preferred embodiments, it is not to be so limited as changes and modifications can be made which are within the full intended scope of the invention as defined by the appended claims.

I claim as my invention:

1. A cart for use in servicing a computer and carrying items for use in servicing a computer, said cart including:

structural frame means for cooperation in carrying items for servicing and for rollably supporting housing forming means, said frame having:

a base for generally horizontal positioning which defines a front, back and sides;

a pair of uprights each connected to the back of the base at an end and extending upwardly therefrom;

a pair of strut members connecting each of said uprights to the base;

a cross member connected to the uprights;

a handle secured to the uprights; rolling means secured to said base by which said cart is rollable; and housing forming means integrally formed with and surrounding said frame means for cooperation therewith, said housing forming means having top, bottom, side, front and back panels so as to define an enclosed space, said bottom panel having a floor-like section and a depressed well-like section centered and extending below the floor-like section between the sides and extending between the front and back, and said back panel including door means for access to the interior of the housing forming means;

wherein said housing forming means also includes a rearward section and forward retaining means secured to said rearward section for carrying various items and at least one front door member hingedly secured to said rearward section and constructed to enclose the forward retaining means; and wherein in the rearward section there is provided a vacuum tank on on side, a cleaning gas cylinder on the other side and a generally vertically oriented hose reel in the center between the tank and cylinder which extends into the welllike section, said reel in communication with the cylinder and a gas nozzle.

2. A cart as in claim 1 wherein said rolling means includes four wheels for supporting said cart, two of the wheels having a first diameter and mounted to the base adjacent the front of the frame base, and there being provided rear wheel mounting means mounted to the frame adjacent the back of the frame for angular securement of the rear wheels to the frame and outwardly of the front wheels with the center of the rear wheel generally aligned with the upright members and said rear wheels each having a greater diameter than the front wheels.

3. A cart as in claim 1 wherein in the rearward section there is provided an opening through which the nozzle on the reel extends into the forward section.

4. A cart as in claim 1 wherein there is further provided a centrally and vertically positioned retractable reel and electric cord mounted in the rearward section adjacent the top thereof and an opening for extension of the electric cord therefrom.

5. A cart as in claim 4 wherein said electric cord is operatively connected to an outlet and an indicator light is associated therewith to indicate the powered state of the cart, a switch is provided and operatively connected to said vacuum tank and a duplex outlet is provided and is electrically connected to the cart via a switch and indicator light.

6. A cart as in claim 2 wherein said rear wheel mounting means includes an angled mounting plate secured to the cart frame, rear wheel bracket means for positioning said rear wheels rearwardly and downwardly therefrom.

7. A cart for use in servicing a computer and carrying items for use in servicing a computer, said cart including:

structural frame means for cooperation in carrying items for servicing and for rollably supporting housing forming means, said frame having:

a base for generally horizontal positioning which defines a front, back and sides;

a pair of uprights each connected to the back of the base at an end and extending upwardly therefrom;

a pair of strut members connecting each of said uprights to the base;

a cross member connected to the uprights;

a handle secured to the uprights;

rolling means secured to said base by which said cart is rollable; and housing forming means integrally formed with and surrounding said frame means for cooperation therewith, said housing forming means having top, bottom, side, front and back panels so as to define an enclosed space, said bottom panel having a depressed welllike section centered and extending below the frame between the sides and extending between the front and back, and said back panel including door means for access to the interior of the housing forming means;

wherein the cart top includes an openable shelf forming element hingedly secured to the cart top and constructed to swing rearwardly and engage a cart handle which is secured to the cart upright and cross member.

8. A cart as in claim 1, wherein said front door is a clam-shell-like configuration.

* * * * *